US010284979B2

(12) United States Patent
Cederberg et al.

(10) Patent No.: US 10,284,979 B2
(45) Date of Patent: May 7, 2019

(54) METHOD OF OPERATING A HEARING AID SYSTEM AND A HEARING AID SYSTEM

(71) Applicant: Widex A/S, Lynge (DK)

(72) Inventors: Jorgen Cederberg, Farum (DK); Michael Ungstrup, Allerod (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/520,730

(22) PCT Filed: Oct. 21, 2014

(86) PCT No.: PCT/EP2014/072480

§ 371 (c)(1),
(2) Date: Apr. 20, 2017

(87) PCT Pub. No.: WO2016/062330

PCT Pub. Date: Apr. 28, 2016

(65) Prior Publication Data

US 2017/0311104 A1 Oct. 26, 2017

(51) Int. Cl.
*H04R 25/00* (2006.01)

(52) U.S. Cl.
CPC ..... *H04R 25/70* (2013.01); *H04R 25/30* (2013.01); *H04R 25/505* (2013.01); *H04R 25/558* (2013.01); *H04R 25/654* (2013.01); *H04R 25/50* (2013.01); *H04R 2225/43* (2013.01)

(58) Field of Classification Search
CPC ..... H04R 25/70; H04R 25/30; H04R 25/505; H04R 25/558; H04R 25/654; H04R 2225/43; H04R 25/50; A61B 5/12; A61B 5/121; A61B 5/123; A61B 5/125; G09B 5/04; G09B 21/006
See application file for complete search history.

(56) References Cited

U.S. PATENT DOCUMENTS 5,825,894 A * 10/1998 Shennib ..... A61B 5/121 381/17
5,884,264 A 3/1999 Ortiz
(Continued)

FOREIGN PATENT DOCUMENTS

| | | | |
|---|---|---|---|
| DE | 10 2009 048 071 | A1 | 11/2010 |
| EP | 1 097 606 | A1 | 5/2001 |
| WO | 2014/094858 | A1 | 6/2014 |

OTHER PUBLICATIONS

David P. Egolf, et al., "Experimental scheme for analyzing the dynamic behavior of electroacoustic transducers", The Journal of the Acoustical Society of America, Oct. 1977, pp. 1013-1023, vol. 62, No. 4.

(Continued)

*Primary Examiner* — Jason R Kurr
(74) *Attorney, Agent, or Firm* — Sughrue Mion, PLLC

(57) ABSTRACT

A hearing aid fitting system (400) adapted for providing sound samples illustrating the impact on sound quality from a hearing aid system defect and a method of providing such sound samples. The invention also relates to a hearing aid system and computer program code capable of carrying out such a method of providing sound samples illustrating the impact on sound quality from a hearing aid system defect and methods of operating and fitting hearing aid systems.

20 Claims, 3 Drawing Sheets

(56) References Cited

U.S. PATENT DOCUMENTS

| | | | | |
|---|---|---|---|---|
| 6,658,122 | B1 * | 12/2003 | Westermann | H04R 25/70 381/312 |
| 2002/0015506 | A1 * | 2/2002 | Aceti | H04R 25/558 381/314 |
| 2009/0202084 | A1 | 8/2009 | Joeng et al. | |
| 2012/0230502 | A1 | 9/2012 | Nishizaki et al. | |

OTHER PUBLICATIONS

International Search Report for PCT/EP2014/072480 dated Jun. 29, 2015 [PCT/ISA/210].

* cited by examiner

METHOD OF OPERATING A HEARING AID SYSTEM AND A HEARING AID SYSTEM

CROSS REFERENCE TO RELATED APPLICATIONS

This application is a National Stage of International Application No. PCT/EP2014/072480, filed on Oct. 21, 2014, the contents of all of which are incorporated herein by reference in their entirety.

The present invention relates to a method of operating a hearing aid system. More specifically the invention relates to a method of simulating the impact of hearing aid system defects on the sound quality provided by the hearing aid system. The present invention also relates to hearing aid systems, hearing aid fitting systems and computer program code adapted to carry out said method.

BACKGROUND OF THE INVENTION

Generally a hearing aid system according to the invention is understood as meaning any system which provides an output signal that can be perceived as an acoustic signal by a user or contributes to providing such an output signal and which has means which are used to compensate for an individual hearing loss of the user or contribute to compensating for the hearing loss of the user. These systems may comprise hearing aids which can be worn on the body or on the head, in particular on or in the ear, and can be fully or partially implanted. However, those devices whose main aim is not to compensate for a hearing loss, may also be considered a hearing aid system, for example consumer electronic devices (televisions, hi-fi systems, mobile phones, MP3 players etc.) that have, however, measures for compensating for an individual hearing loss.

Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit.

In a traditional hearing aid fitting, the hearing aid user visits an office of a hearing aid fitter, and the user's hearing aids are adjusted using the fitting equipment that the hearing aid fitter has in his office. Typically the fitting equipment comprises a computer capable of executing the relevant hearing aid programming software, and a programming device adapted to provide a link between the computer and the hearing aid.

Within the present context a hearing aid can be understood as a small, battery-powered, microelectronic device designed to be worn behind or in the human ear by a hearing-impaired user. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

The mechanical design of hearing aids has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal.

In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system. Thus within the present context the term "hearing aid system device" may denote a hearing aid or an external device.

The present invention, in particular, relates to hearing aid systems comprising an ear canal part prepared for being arranged in the ear canal of a hearing aid user and wherein the ear canal part has at least one sound opening or sound outlet provided with an ear wax guard. In traditional BTE hearing aids the sound opening is connected to the receiver with a sound tube. For RITE, RIC, ITE and CIC hearing aids a short tubing is normally used to convey the sound from the receiver and to the sound opening. In the present context a sound tube or tubing may also be denoted a sound bore or sound conduit.

It is a well-known problem that the sound opening is exposed to contamination with cerumen or ear wax which may lead to clogging of the sound outlet with consequently reduced sound reproduction. At worst, there may be a risk for the ear wax to enter the ear canal part and result in damage to the electrical components of the hearing aid such as the hearing aid receiver.

In order to avoid ear wax from the human ear canal to enter through this sound opening, an ear wax guard is usually applied. Such an ear wax guard is known from e.g. EP 1 097 606 B1. Ear wax guards are exchangeable and need to be replaced on a regular basis in order not to have the sound outlet blocked by ear wax. The time between changes of the ear wax guard varies between persons, because the amount and characteristics of ear wax produced may differ significantly from person to person.

However as a consequence of the very small dimensions where the sound outlet typically has a diameter in the range of about 1-2 mm, the insertion and removal of the ear wax guard is a rather difficult operation, especially for weak-sighted and elderly hearing aid users. As a consequence, it often happens that ear wax guards are not replaced as often as they should whereby the risk of ear wax entering the ear canal part is increased, and hereby also increasing the risk of damaging especially the hearing aid receiver.

Another issue with hearing aid systems is that the performance of the transducers, i.e. the microphones and receivers, may degrade due to normal aging or due to rough handling resulting from e.g. a hearing aid being dropped by the user.

Yet another issue with traditional BTE hearing aid systems is that the performance may degrade if the sound tube having the correct dimensions (length and diameter) is replaced, e.g. by the user himself or herself, with a sound tube where the dimensions are no longer correct.

Reduced performance of the hearing aid system may have the consequence that the hearing aid system is not worn by a user or that a user having the hearing aid system on trial selects not to purchase it.

Yet another issue with hearing aid systems is that it may be difficult for a hearing aid fitter to provide appropriate counseling of the hearing aid system user based on verbal user feedback.

It is therefore a feature of the present invention to provide a method of fitting a hearing aid system that improves a hearing aid system user's and hearing aid fitter's awareness to the issues of ear wax congestion, transducer performance and other hearing aid system defects.

It is another feature of the present invention to provide a hearing aid fitting system adapted to improve a hearing aid system user's awareness of ear wax congestion, transducer performance and other hearing aid system defects.

It is yet another feature of the present invention to provide a hearing aid system adapted to improve the hearing aid system user's awareness to the issue of ear wax congestion, transducer performance and other hearing aid system defects.

SUMMARY OF THE INVENTION

The invention, in a first aspect, provides a method of operating a hearing aid system comprising the steps of: identifying the hearing aid system type, selecting a hearing aid system defect, and producing a sound sample demonstrating the impact on the sound quality of the identified hearing aid system from the selected hearing aid system defect.

This provides a method capable of simulating the impact of hearing aid system defects on the sound quality provided by the hearing aid system.

The invention, in a second aspect, provides methods of fitting a hearing aid system comprising the steps of: selecting a hearing aid system type for an individual hearing aid user, operating the hearing aid system according to the method described above, and then programming the hearing aid system based on the hearing deficit of the individual hearing aid user.

This provides an improved method of fitting a hearing aid system.

The invention, in a third aspect, provides a computer program for operating a hearing aid system or hearing aid fitting system, the computer program comprising program code carried on a non-transient computer readable medium and executable to carry out the steps according to the method described above.

This provides an improved computer program for a hearing aid system.

The invention, in a fourth aspect, provides a hearing aid system of the type including a processor for processing a sound to at least partially compensate for a hearing loss of an individual, and a hearing aid system output transducer for producing the processed sound, said hearing aid system further comprising: a hearing aid system defect simulator configured to demonstrate to said individual a difference in sound provided by a defect and by a normal hearing aid system. The hearing aid system defect simulator may comprise: a memory holding data representing at least two sound samples, wherein the sound samples are adapted to illustrate the difference in sound provided by a defect and by a normal hearing aid system.

This provides improved hearing aid systems.

The invention, in a fifth aspect, provides a hearing aid fitting system for fitting a hearing aid system to compensate for a hearing loss of an individual, said hearing aid system of the type including a processor for processing sound to at least partially compensate for said hearing loss and a hearing aid system output transducer for producing the processed sound, said hearing aid fitting system further comprising a hearing aid system defect simulator configured to cause said hearing aid system to demonstrate to said individual a difference in sound provided by a defect and by a normal hearing aid system. The hearing aid system defect simulator may comprise: a memory holding data representing at least two sound samples, wherein the sound samples are adapted to illustrate the difference in sound provided by a defect and by a normal hearing aid system.

This provides improved hearing aid fitting systems.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

The inventors have found that, if a hearing aid user, as part of the initial hearing aid fitting procedure, or as part of the normal operation, is presented for a simulation, that illustrates how the acoustical output of the hearing aid system depends on various hearing aid system parameters such as the sound tube dimensions of traditional BTE hearing aid systems, wax congestion, positioning of hearing aid part in the ear canal and transducer performance, then the general user satisfaction may be significantly improved and the return rate, for hearing aid systems borrowed for trial, may likewise be significantly reduced, due to the user's improved awareness of the possible issues with hearing aid systems and the often simple measures that can be taken to solve these issues.

Within the present context the term "hearing aid system defect" may also be used to represent at least the hearing aid system parameters mentioned above.

Additionally the inventors have found that the hearing aid system fitter may likewise benefit from this improved awareness of how the various issues may manifest themselves in the provided hearing aid system sound, because the fitter's ability to counsel the hearing aid system user is significantly improved.

However, within the present context a user may be a hearing aid system user or a hearing care professional which may also be denoted a hearing aid system fitter.

Within the present context the terms hearing aid fitting system, computing device and external device may be used interchangeably. However, it should be noted that traditional hearing aid fitting systems do not include the hearing aid system itself, while this may be the case for other hearing aid fitting systems—with generally a more limited functionality—that may be implemented in an external device or a computing device of a hearing aid system.

Figure 1:
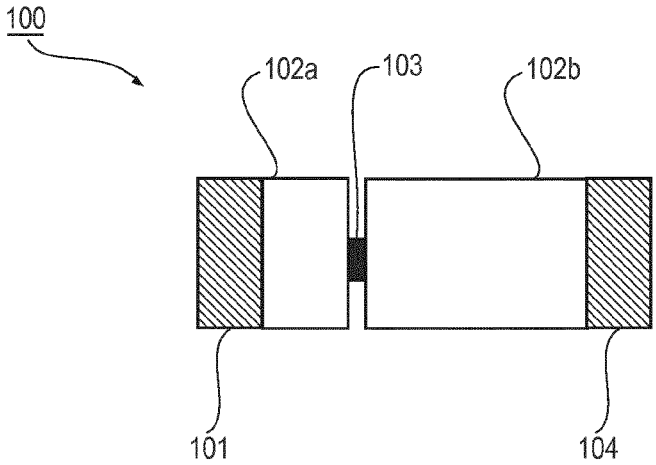
FIG. 1 illustrates highly schematically a two-port model of a hearing aid system according to an embodiment of the invention.

Reference is now given to FIG. 1, which illustrates highly schematically a two-port model 100 of a hearing aid system used to simulate the effect of ear wax congestion in a wax guard of the hearing aid system according to an embodiment of the invention. The two-port model of the hearing aid system includes the receiver 101, sound tubings 102*a* and 102*b*, wax guard 103 and acoustical load 104.

The wax congestion of the wax guard is modelled as a thin tube section with a cross-sectional area where through sound can propagate and wherein the cross-sectional area is reduced in accordance with the assumed wax congestion.

Typically the analog equivalent schematics required to model a receiver in the two-port model is provided by the receiver manufacturer. However, in further variations the receiver may be modelled based on measurements. In yet further variations the measurements may be obtained using the two-load method. Further details relating to the two-load method may be found in the paper "Experimental scheme for analyzing the dynamic behavior of electroacoustic transducers" by Egolf, D. P., & Leonard, R. G., in J. Acoust. Soc. Am. 62, 1013-1023 (1977).

In variations a more or less sophisticated model can be applied. According to the present embodiment the specific receiver type and tubings are used. Hereby, a variety of different hearing aid system types can be selected and modelled since the primary difference between e.g. traditional BTE hearing aid systems and RITE, RIC and CIC systems is the receiver type and the tubing characteristics.

According to the present embodiment the acoustical load is modelled using the response of a standard 711-coupler in order to simulate the residual volume between the hearing aid system and the ear drum of a hearing aid user. In variations the acoustical load is modelled as free space, which represents the case where the hearing aid system is not inserted in an ear canal.

In order to simulate the impact from wax congestion a selected acoustical model is first adapted to represent the case of no wax congestion, i.e. the wax guard is modelled by a thin tube section with a cross-sectional area that is not reduced, hereby providing a first adapted acoustical model.

A second acoustical model can be adapted from the first adapted acoustical model by assuming a given non-zero amount of wax congestion hereby providing a second adapted acoustical model.

By comparing the transfer functions of the first and second adapted acoustical models a linear filter, adapted to simulate the effect of wax congestion, can be derived.

According to the present embodiment the transfer function of the filter is derived from the ratio between the transfer functions of the second adapted acoustical model over the first adapted acoustical model.

Thus, in order to illustrate the impact from wax congestion on the sound provided by the hearing aid system, then initially a first sound sample, representing the case of no wax congestion, is provided to the user and subsequently a first modified sound sample is provided to the user by filtering a digital signal representing the first sound sample in the adapted filter, whereby the first modified sound sample represents the case of a given amount of wax congestion.

According to another embodiment of the invention the two-port model 100 of the hearing aid system is used to simulate the effect of sound conduit congestion generally, since congestion may also result from water condensation in the sound conduit.

According to yet another embodiment of the invention the two-port model 100 of the hearing aid system is used to simulate the effect of sound tube dimensions. The inventors have realized that some hearing aid users may think that the hearing aid system is malfunctioning in case the hearing aid system is assembled with a sound tube with incorrect dimensions (length and/or cross-section). Thus, the impact from having a sound tube with incorrect dimensions may be illustrated using methods similar to those disclosed in order to illustrate the impact from wax congestion.

According to yet another embodiment of the invention the two-port model 100 of the hearing aid system is used to simulate the effect of the physical fit of the hearing aid system earpiece in the ear canal of a user, by varying the characteristics of the acoustical load (i.e. the residual volume). The inventors have realized that some hearing aid users may think that the hearing aid system is malfunctioning in case the hearing aid system ear piece is not positioned (fitted) correctly in the ear canal of the user. Thus, the impact from having an incorrectly positioned ear piece may be illustrated using methods similar to those disclosed in order to illustrate the impact from wax congestion and incorrect tube dimensions.

Figure 2:
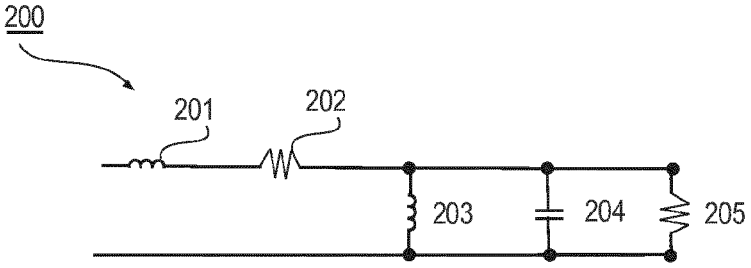
FIG. 2 illustrates a simplified equivalent circuit of a hearing aid system earpiece according to an embodiment of the invention.

Reference is now made to FIG. 2, which illustrates a simplified equivalent circuit of a hearing aid earpiece 200 according to another embodiment of the invention. The equivalent circuit comprises a first inductance 201, a direct current resistance 202, a parallel circuit comprising a second inductance 203 given as $M^2$ nS, a first capacitance 204 given as $m/M^2S$ and a second resistance 205 given as $M^2S/w$, wherein M represents the electromagnetic converter constant, S the membrane surface of the receiver, n the compliance of the membrane and of the load volume, m the membrane mass and w the losses. The output side of the equivalent circuit 200 provides a current given as p/M and voltage given as My wherein p represents the sound pressure and v the sound velocity.

Hereby the impact from the size of the residual volume may be modelled in a very simple manner using the simplified equivalent circuit 200. It is well known that this type of equivalent circuit provides a transfer function having a mechanical resonance and that the frequency of the mechanical resonance is mainly influenced by the mass of the moving parts of the earpiece, e.g. the armature, the membrane and the load volume, especially the auditory canal volume. Therefore, the impact from a changed auditory canal volume (which may also be denoted the residual volume) may be illustrated simply by considering the ratio of the transfer functions derived from two equivalent circuits based on two different auditory canal volumes. The other component values of the equivalent circuit will be readily available for a person skilled in the art, especially since hearing aid receiver manufacturers normally provide these data.

According to still another embodiment the impact from having a defect hearing aid transducer may be illustrated by using a transducer model that incorporates the non-linear aspects. This is especially advantageous because a significant number of hearing aid system receivers may suffer from degraded performance if e.g. the receivers have been dropped by the user. By improving the hearing aid system user's ability to detect this type of degraded performance, the user will be more likely to take appropriate action and hand in the defect hearing aid transducer for repair or replacement instead of accepting the degraded performance or stop using the hearing aid system.

Figure 3:
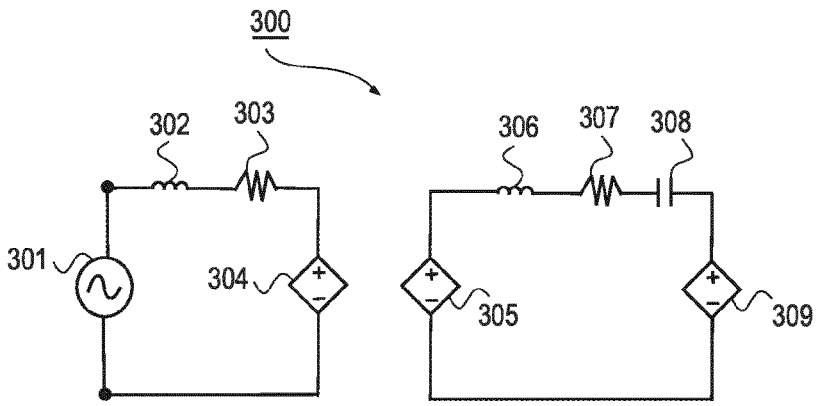
FIG. 3 illustrates an electrical equivalent circuit of a hearing aid system receiver according to an embodiment of the invention.

Reference is now made to FIG. 3 that shows a non-linear electro-acoustical time-domain model (in the form of an electrical equivalent circuit) 300 of an electro-dynamic transducer according to an embodiment of the invention. The model is capable of predicting the diaphragm displacement as a function of the signal fed to a hearing aid receiver of the balanced armature type. The model 300 comprises a voltage supply 301 that represents the voltage of the signal that is fed to the receiver, a first inductor 302 that represents the non-linear inductance of the receiver, a first resistor 303 that represents the resistance of the receiver, a first dependent voltage source 304 that represents an induced voltage proportional with the product of the force factor (that may also be denoted transduction coefficient) and the mechanical speed of the receiver armature (that is represented by the current in the right part of the electrical equivalent circuit), a second dependent voltage source 305 that represents an induced voltage proportional with the product of the force factor and the electrical current in the left part of the electrical equivalent circuit, a second inductor 306, a second resistor 307, a capacitor 308 that represents the inverse of the receiver stiffness and a third dependent voltage source 309. Generally the left part of the electrical equivalent circuit represents the electrical part of the balanced armature receiver and the right part of the electrical equivalent circuit represents the mechanical part.

Having this non-linear electro-acoustical time-domain model 300 various non-linear phenomena for a hearing aid system receiver can be simulated and hereby also the impact on the provided sound quality. The inventors have realized that rough handling of a hearing aid (such as dropping the hearing aid) may result in displacement of the voice coil and/or mechanical suspension system, which changes the non-linear behavior of the hearing aid receiver and leads to increased distortion of the provided sound.

The component values of the equivalent circuit will be readily available for a person skilled in the art, especially since hearing aid receiver manufacturers normally provide these data. Alternatively, the component values can be estimated through dedicated measurements.

However, in variations other transducer models capable of modelling the non-linear behavior of hearing aid system receivers may be used.

In variations any type of linear filter, such as e.g. a FIR filter or an IIR filter, may be used to simulate the impact from the various hearing aid system defects that may be considered linear and therefore conveniently can be simulated using such filters. At least the hearing aid defects resulting from ear wax congestion, changed sound conduit dimensions and changed residual volume characteristics may be considered linear.

In other variations the filter needs not be determined based on transfer functions of hearing aid models. According to one further embodiment the filter is adapted based on transfer functions derived from measurements of the sound output from a hearing aid system without and with a hearing aid system defect.

According to yet another variation the filter is not used when providing a modified sound sample, instead a number of modified sound samples representing both a variety of hearing aid system types and a variety of hearing aid system defects are recorded and stored in a memory wherefrom they can be retrieved by a hearing aid system user or a hearing care professional (also denoted a fitter).

Figure 4:
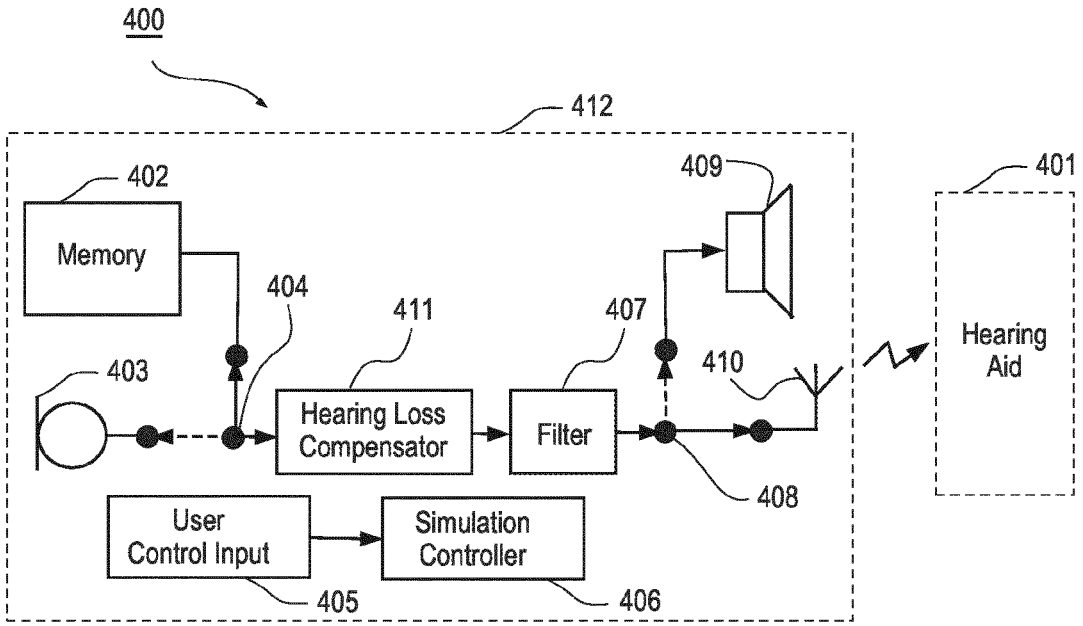
FIG. 4 illustrates highly schematically a hearing aid fitting system and a hearing aid according to an embodiment of the invention.

Reference is now made to FIG. 4, which illustrates highly schematically a hearing aid fitting system 400 that comprises a hearing aid fitting device 412 and a hearing aid 401 according to an embodiment of the invention.

For clarity the main parts of the hearing aid fitting system, i.e. the functional parts of the hearing aid fitting device 412 that are responsible for programming the hearing aid 401, are not shown. Likewise for clarity no details of the hearing aid 401 are shown.

The hearing aid fitting device 412 comprises a memory 402, an acoustical-electrical input transducer 403, a first switch 404, and a user control input 405, a simulation controller 406, a hearing loss compensator 411, a filter 407, a second switch 408, an electrical-acoustical output transducer 409 and an antenna 410. For clarity the transceiver that allows wireless signals to be transmitted between the hearing aid fitting device 412 and the hearing aid 401 is not shown.

The memory 402 is adapted to store digital content representing sound samples adapted to illustrate the impact from certain hearing aid system defects on the sound quality provided by the hearing aid system.

The first switch 404 is configured to selectively route the signals from the memory 402 or the acoustical-electrical input transducer 403 to the hearing loss compensator 411 and further on to the filter 407, and the second switch 408 is configured to selectively route the filtered signals from the filter 407 to the electrical-acoustical output transducer 409 or to the antenna 410 and further on to the hearing aid 401. The user control input 405 is adapted to allow a user to make selections with respect to which hearing defect is to be simulated and how the simulated sounds are to be provided. The user selections are subsequently provided to the simulation controller 406. For clarity reasons the control signals from the simulation controller 406 are not shown. Thus according to the present embodiment the user may select whether the simulation is to be carried out based on ambient sounds through the acoustical-electrical input transducer 403 or based on pre-recorded samples stored in the memory 402, and the user may also select the type of hearing aid defect that is to be simulated. Finally the user may decide whether the simulated sound is to be provided by the electrical-acoustical output transducer 409 of the hearing aid fitting device 412 or to be provided by the electrical-acoustical output transducer of the hearing aid 401 via the antenna 410. In the latter case the simulated sound may be provided to the hearing aid 401 using methods well known in the art of hearing aids for streaming sound from an external device and to the hearing aid. In a variation the streamed signal comprises information that provides for the part of the streamed signal that represents the simulated sound to be provided directly to the electrical-acoustical output transducer of the hearing aid 401 without being compensated for the user's hearing loss. This is advantageous because a hearing loss compensation may already have been applied in the hearing aid fitting system 412 by the hearing loss compensator 411 in the situations where the hearing aid defect to be simulated originates downstream of the hearing loss compensation, because the sound that is ultimately provided to the hearing aid user may depend significantly on whether the hearing loss compensation or the filtering adapted to simulate a hearing aid defect is applied first.

However, according to another variation of the present embodiment the hearing loss compensator 411, of the hearing aid fitting device 412, is by-passed in case where the hearing aid defect to be simulated originates upstream of the hearing loss compensation in the hearing aid. This is the case e.g. for defects in the acoustical-electrical input transducer and for this case it therefore makes more sense to use the hearing loss compensation in the hearing aid.

According to an additional variation the hearing loss compensator 411 of the hearing aid fitting device 412 is by-passed in case where some of the digital content, stored in the memory 402, represents sound samples that have already been compensated for a hearing loss.

The embodiment according to FIG. 4 is advantageous in so far that it requires little or no modification of the hearing aid 401 in order to provide a simulation of a hearing aid defect to a hearing aid user through his hearing aids.

The embodiment according to FIG. 4 is furthermore advantageous in so far that it allows a hearing aid fitter or a relative of the hearing aid user to listen directly to sounds representing the various possible hearing aid defects in order to provide better counseling of the hearing aid user. Thus according to a further variation it is possible to select to by-pass the hearing loss compensator at any time, which may be advantageous in some cases for e.g. a hearing aid fitter or a relative of the hearing aid user when listening to the simulated sounds through the electrical-acoustical output transducer 409 of the hearing aid fitting system.

In yet another variation of the embodiment of FIG. 4 the hearing aid fitting device 412 comprises a non-linear electro-acoustical time-domain model (not shown) such as the one given with reference to FIG. 3. This type of model differs from a linear two-port model such as those given with reference to FIG. 1 and FIG. 2 in that the physical receiver parameters such as force factor and electrical inductance can vary with the input signal, and consequently a hearing aid defect that requires a non-linear electro-acoustical time-domain model in order to be simulated is preferably simulated by: providing an electrical input signal that is adapted to represent a first sound sample, processing the electrical input signal using the non-linear electro-acoustical time-domain model, and hereby providing an electrical output signal representing a second sound sample and illustrating the impact from the hearing aid defect incorporated in the non-linear electro-acoustical time-domain model.

Subsequently the second sound sample may be stored in the memory 402, and when the sound sample is selected for being provided to the electrical-acoustical output transducer 409, then the hearing loss compensator 411 and the filter 407 are both bypassed or made transparent because the first sound sample is processed in order to compensate a hearing aid user's hearing loss before being used as input to the non-linear electro-acoustical time-domain model.

However, in case the simulation is intended for a relative to the hearing aid user or a hearing aid fitter then it may be selected to not compensate for the hearing loss of the hearing aid user, neither for the first sound sample nor for the second sound sample. Thus in order to simulate a hearing aid defect the non-linear electro-acoustical time-domain model is adapted to include a hearing aid defect and in order to compare with a not defect hearing aid the non-linear electro-acoustical time-domain model is adapted to not include that defect. Typically a defect is incorporated in the model by changing the non-linear behavior of a model component.

According to the present embodiment the user has the option to input the type of hearing aid system. In variations this information has been retrieved automatically and therefore does not need to be input. According to a specific variation the information is retrieved from a network server based on a unique hearing aid system or hearing aid user identification. One example of a unique hearing aid system identification is the MAC address of a hearing aid system device, and according to a further variation the hearing aid user identification is input by the user.

According to yet another variation the hearing aid user is required to sanction that personal information, such as hearing aid system type and hearing loss, is retrieved from a network server.

In case the simulation is to be carried out based on ambient sounds received through the acoustical-electrical input transducer 403, then the filter 407 setting is changed in response to—and in order to simulate—the selected hearing aid system defect.

In case the simulation is to be carried out based on pre-recorded sound samples stored in the memory 402, then the filter 407 may be bypassed or set to provide a transparent filter in case the stored pre-recorded sound samples comprise both samples representing sound from a normal operating hearing aid system and samples representing sounds from a hearing aid system with some defect. In case the stored pre-recorded samples only comprise samples representing sound from a normal operating hearing aid system then the filter 407 setting is changed in response to—and in order to simulate—the selected hearing aid system defect.

Thus within the present context the term "sound sample" may be used to represent both ambient sound received through an acoustical-electrical input transducer, pre-recorded sound and synthetically generated sound. In a hearing aid system the sound samples will at some point be represented by digital signals. However, digital data representing a received, pre-recorded or synthetically generated sound sample may be stored in a memory wherefrom the corresponding digital signals can be provided. Thus in the following the term sound sample may be used to denote an acoustical sound, the digital signal representing the acoustical sound and digital data that may be converted into the digital signal. Furthermore the term sound sample may also be used to represent a sound sample that has been processed in order to be able to illustrate the impact on the sound quality by a selected hearing aid system defect and therefore the term sound sample may be used interchangeably with the term "processed sound sample". In variations intended to simulate a certain hearing aid system defect for a certain hearing aid type, the settings of the filter 407 are controlled by a computer implemented model. In variations the computer implemented model is an electrical equivalent circuit or a two port model.

Figure 5:
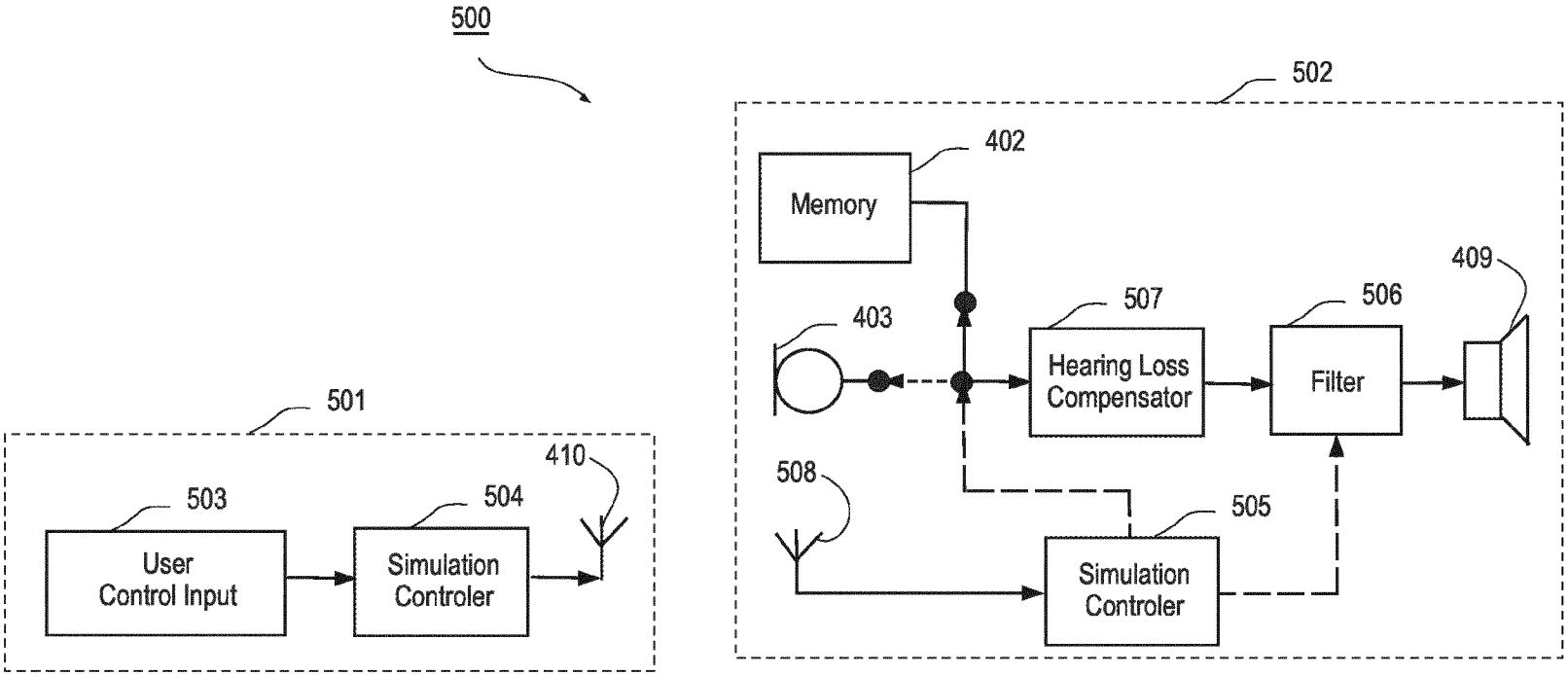
FIG. 5 illustrates highly schematically a hearing aid system comprising an external device and a hearing aid according to an embodiment of the invention.

Reference is now given to FIG. 5, which illustrates highly schematically a hearing aid system 500 according to an embodiment of the invention.

The hearing aid system 500 comprises a hearing aid 502 and an external device 501. The external device 501 comprises a user control input 503, a simulation controller 504 and an antenna 410. For clarity the transceiver that allows wireless signals to be transmitted between the external device 501 and the hearing aid 502 is not shown.

The user control input 503 has functionality similar to what is already disclosed for the user control input of FIG. 4, thus the user control input 503 is adapted to allow a user to make selections with respect to the type of defect that is to be simulated, the degree of the defect and whether pre-recorded or ambient sounds are used as basis for the simulations. The user selections are subsequently fed to the simulation controller 504, which in response provides the appropriate instructions in order carry out the simulation that has been selected by the hearing aid user.

According to the present embodiment the instructions from the simulation controller 504 are wirelessly transmitted to the simulation controller 505 in the hearing aid, using the antennas 410 and 508. In response to receiving said instructions the simulation controller 505 sets the switch 404 and the filter 506 and initiates the simulation. The instructions may comprise the data required for setting the filter such that it provides the desired transfer function, but in variations the instructions only comprise the user selections, and the simulation controller 505 therefore retrieves the filter settings from a memory (not shown in FIG. 5) based on the user selections. Thus the memory holding the filter settings corresponding to the user selections may be accommodated in the hearing aid, in the external device of the hearing aid system, or on a network server that the external device may access. In order to select the correct filter settings knowledge of the present hearing aid system type is also required, which information may be obtained in a variety of ways already disclosed above with reference to FIG. 4.

In a variation of the embodiment of FIG. 5 the simulation controller 504 of the external device 501 retrieves a simulated sound sample, based on the user selections and in accordance with the principles disclosed with reference to FIG. 3, and transmits the sound sample to the hearing aid 502 in order for it to be provided to the hearing aid user through the hearing aid receiver 409. According to the present embodiment the simulated sound sample is based on an input signal that has been compensated for the hearing loss of the hearing aid user, and therefore the hearing loss compensator 507 and filter 506 are by-passed when providing the simulated sound sample to the hearing aid user.

In a further variation the simulated sound samples are stored in the memory 402 of the hearing aid 502 and, based on the user selections, the simulation controller 504 of the external device 501 wirelessly transmits instructions to the simulation controller 505 of the hearing aid that a corresponding simulated sound sample is to be provided to the hearing aid receiver 409 while by-passing the hearing loss compensator 507 and filter 506.

According to variations the simulation of degraded performance due to a hearing aid system defect can be carried out by downloading a software application (a so called app) to an external device such as a smart phone, wherein the app is capable of providing the various sound samples disclosed in the various embodiments according to the invention. The sound samples may be provided directly by the external device, but may also be provided by the hearing aids according to digital signals representing the sound samples that have been transmitted from the external device and to the hearing aids.

According to a further variation the app may access a network server holding information of the hearing aid system, such as receiver type and sound tube dimensions and/or information related to the hearing aid user such as the hearing loss. The app may further be adapted to access said network server based on a unique hearing aid system or hearing aid user identification. The identification may be retrieved automatically by the app e.g. by reading the MAC address of a hearing aid system device, or the unique identification may be input by the hearing aid user. In the latter case the hearing aid user may at the same time sanction that the app accesses the user's personal information, such as hearing aid system type and hearing loss, stored at some network server.

According to still another variation of the present invention the simulations may be used to help a hearing aid system user deciding how much extra gain should be applied to a message provided by the hearing aid in order to alert the user that e.g. an ear wax guard is congested and consequently needs to be replaced.

Generally the variations, mentioned in connection with a specific embodiment, may, where applicable, be considered variations for the other disclosed embodiments as well.

This is especially true with respect to the fact that variations disclosed for a hearing aid fitting system may also be considered variations of hearing aid systems and vice versa.

Thus, as one example, the hearing aid fitting system of FIG. 4 may as well be denoted a hearing aid system. This is a result of the fact that present day hearing aid systems may offer the user (limited) possibilities of fitting (i.e. programming or fine-tuning) the hearing aid system using e.g. the interface of an external computing device of the hearing aid system.

However, according to yet another variation of the hearing aid fitting system of FIG. 4 the fitting functionality is omitted hereby providing a more traditional hearing aid system.

The invention claimed is:

1. A method of operating a hearing aid system comprising the steps of:

identifying the hearing aid system type, selecting a hearing aid system defect, and producing a sound sample demonstrating the impact on the sound quality of the identified hearing aid system from the selected hearing aid system defect.

2. The method according to claim 1, wherein the step of identifying the hearing aid system type comprises the steps of:

retrieving a unique hearing aid system identification or a unique hearing aid user identification, accessing a network server and identifying the hearing aid system type based on the unique hearing aid system identification.

3. The method according to claim 1, wherein the step of identifying the hearing aid system type comprises the step of:

retrieving the hearing aid system type from a memory of the hearing aid system.

4. The method according to claim 1, wherein the step of selecting a hearing aid system defect is carried out using an external device of the hearing aid system.

5. The method according to claim 1, wherein said hearing aid system defect may be selected from a group consisting of:

ear wax congestion by a given amount present at a sound output of the hearing aid system, a sound tube with given incorrect dimensions, incorrect positioning of a hearing aid system earpiece in an ear canal, and degraded performance of an electrical-acoustical transducer.

6. The method according to claim 1, wherein the step of providing the sound sample comprises the steps of:

providing a sound sample that is one of (i) a sound sample received through an acoustical-electrical input transducer, (ii) a pre-recorded sound sample or (iii) a synthetically generated sound sample, to a user of the hearing aid system, wherein the provided sound sample illustrates the case where the hearing aid system operates without defects, modifying the provided sound sample using a filter operating in accordance with filter settings to thereby provide the sound sample illustrating the impact on the sound quality of the identified hearing aid system by the selected hearing aid system defect.

7. The method according to claim 6, wherein the filter settings are derived using the steps of:

providing a model of the electro-acoustical behavior of the hearing aid system, deriving a first transfer function for the model of the electro-acoustical behavior for the case of no hearing aid system defects, deriving a second transfer function for the model of the electro-acoustical behavior for the selected hearing aid system defect, deriving the transfer function of the filter as the ratio of the second transfer function over the first transfer function, and setting the filter to provide the derived transfer function of the filter.

8. The method according to claim 1, wherein the step of providing the sound sample comprises the steps of:

retrieving, from a memory of the hearing aid system, data representing a sound sample, and providing the sound sample illustrating the impact on the sound quality of the identified hearing aid system from the selected hearing aid system defect based on the data retrieved from the memory of the hearing aid system.

9. The method according to claim 1, wherein the step of providing the sound sample comprises the steps of:

providing a model of the electro-acoustical behavior of the hearing aid system, adjusting the model to reflect the selected hearing aid system defect, and deriving the sound sample from the adjusted model.

10. The method according to claim 9, wherein the step of providing a model of the electro-acoustical behavior of the hearing aid system comprises the step of:

providing a two-port model comprising modelling of a hearing aid receiver, a sound conduit from the hearing aid receiver and to a hearing aid system sound output, ear wax congestion at the sound output and an acoustical load representing the residual volume between the hearing aid system, when inserted in an ear canal, and the ear drum of the ear canal.

11. A method of fitting a hearing aid system comprising the steps of:

selecting a hearing aid system type for an individual hearing aid user, operating the hearing aid system according to the methods of claim 1, programming the hearing aid system based on the hearing deficit of the individual hearing aid user.

12. A non-transient computer-readable medium carrying thereon program code executable to carry out the steps according to claim 1.

13. A method of fitting a hearing aid system comprising the steps of:

selecting a hearing aid system type for an individual hearing aid user, and producing a sound sample to a user of the hearing aid system, wherein the sound sample demonstrates how a sound quality of said hearing aid system may degrade in response to a selected hearing aid system defect.

14. The method according to claim 13, wherein said selected hearing aid system defect belongs to a group consisting of:

ear wax congestion by a given amount present at a sound output of the hearing aid system, a sound tube with given incorrect dimensions, incorrect positioning of a hearing aid system earpiece in an ear canal, and degraded performance of an electrical-acoustical transducer.

15. A hearing aid system of the type including a processor for processing a sound to at least partially compensate for a hearing loss of an individual, and a hearing aid system output transducer for producing the processed sound, said hearing aid system further comprising:

a hearing aid system defect simulator configured to cause said output transducer to demonstrate to said individual a difference in sound provided by a defect and by a normal hearing aid system.

16. The hearing aid system according to claim 15, wherein said hearing aid system defect simulator comprises:

a memory holding data representing at least two sound samples, wherein the sound samples are adapted to illustrate the difference in sound provided by a defect and by a normal hearing aid system.

17. A hearing aid system according to claim 15, wherein said hearing aid system defect simulator comprises a memory holding data representing at least two sound samples, wherein the sound samples are adapted to illustrate the difference in sound provided by a defect and by a normal hearing aid system.

18. A hearing aid fitting system for fitting a hearing aid system to compensate for a hearing loss of an individual, said hearing aid system of the type including a processor for processing sound to at least partially compensate for said hearing loss and a hearing aid system output transducer for producing the processed sound, said hearing aid fitting system further comprising a hearing aid system defect simulator configured to cause said output transducer to demonstrate to said individual a difference in sound provided by a defect and by a normal hearing aid system.

19. The hearing aid fitting system according to claim 18, wherein said hearing aid system defect simulator comprises:

a memory holding data representing at least two sound samples, wherein the sound samples are adapted to illustrate the difference in sound provided by a defect and by a normal hearing aid system.

20. The hearing aid fitting system according to claim 18, wherein said hearing aid system defect simulator comprises a filter adapted to provide a transfer function that illustrates the difference in sound provided by a defect and by a normal hearing aid system.

* * * * *